United States Patent [19]

Rammos et al.

[11] Patent Number: 4,743,915

[45] Date of Patent: May 10, 1988

[54] FOUR-HORN RADIATING MODULES WITH INTEGRAL POWER DIVIDER/SUPPLY NETWORK

[75] Inventors: Emmanuel Rammos, Creteil; Bernard M. Bizery, Paris, both of France

[73] Assignee: U.S. Philips Corporation, New York, N.Y.

[21] Appl. No.: 870,275

[22] Filed: Jun. 3, 1986

[30] Foreign Application Priority Data

Jun. 4, 1985 [FR] France ..... 85 08398

[51] Int. Cl.[4] ..... H01Q 13/02

[52] U.S. Cl. ..... 343/776; 343/786

[58] Field of Search ..... 343/786, 771, 772, 776, 343/777, 778

[56] References Cited

U.S. PATENT DOCUMENTS

| | | | |
|---|---|---|---|
| 2,398,095 | 4/1946 | Katzin | 343/786 |
| 2,822,541 | 5/1958 | Sichak et al. | 343/786 |
| 2,895,134 | 7/1959 | Sichak | 343/786 |

*Primary Examiner*—William L. Sikes
*Assistant Examiner*—Michael C. Wimer
*Attorney, Agent, or Firm*—Robert J. Kraus

[57] ABSTRACT

A high-frequency antenna unit module for receiving or transmitting a rectilinearly polarized wave including radiating elements in the form of horns and a waveguide supply network. The module has four horns with square apertures which form a bidimensional network in a plane parallel to a reference plane P. The supply network is of the "planar" type having first pairs of opposing sidewalls extending in a direction parallel to P, and of the "tree-structured" type because all of the horns are fed in-phase by T-shaped power dividers. The waveguide sections have sidewall dimensions a and b, where $a>b$ and $a=\lambda_c/2$. The dimension b is the width of each of the opposing sidewalls extending parallel to P, and a is the height of opposing sidewalls extending perpendicularly to P and connecting each of the first pairs of sidewalls. The network is suitable for propagating the $TE_{01}$ mode along which the electric field vector $\vec{E}$ propagates in parallel with the plane P. Branches of the power dividers are rectilinear or curved so as to enable the propagation of the electric field vector $\vec{E}$ perpendicularly to the sidewalls which are perpendicular to the plane P.

9 Claims, 9 Drawing Sheets

FOUR-HORN RADIATING MODULES WITH INTEGRAL POWER DIVIDER/SUPPLY NETWORK

BACKGROUND OF THE INVENTION

The invention relates to a unit module for a high-frequency antenna for receiving or transmitting a rectilinearly polarized wave, comprising radiating elements in the form of horns and a power supply network assembled from waveguides of rectangular cross-section connected to the horns and also interconnected such that for each horn the total overall length of the supply path is the same.

The invention also relates to a high-frequency antenna comprising such unit modules.

The invention is used, for example, in making planar antennas for receiving television broadcasts which are transmitted via artificial satellites.

An antenna comprising radiating elements in the form of horns fed by waveguides is disclosed in the Patent Specification DE 2641711 (corresponding to Great Britain Patent Specification 1,584,034), which describes a linear antenna module, formed by a row of horns which are manufactured in one glass fibre block with metal-plated surfaces. This row of horns is supplied by a main line and also by individual lines connected to the main line. The main line has a rectangular cross-section, is made from aluminium and may be filled with a dielectric material. This main line is realized such that in the plane of the electric field $\vec{E}$ it constitutes a multi-stage power divider by means of which it is possible to supply at equal powers the waveguides which provide the individual connection of the horns to the main line. Each of these waveguides, of rectangular cross-section, is constituted by a laminated structure having a dielectric material provided between two copper layers, the edges of this structure being metal-plated. The length of the individual supply waveguides and also the point in which they are connected to the main line are chosen such that for each horn the length of the supply path formed by the main line and the individual supply line will be the same. Such a structure has for its object to enable phase differences to be corrected in the supply of the horns by reducing the length of certain individual power supply lines.

However, such an antenna has several disadvantages. First of all it has of necessity very high losses since the propagation of the waves in a dielectric medium such as the medium constituted by the laminated structure of the individual power supply lines of the horns is always subjected to high losses, even if the dielectric material is of a very good quality. Using an identical dielectric material in the main line increases the losses still further. Adding to that is the fact that the price of a high-grade dielectric material is always very high and considerably increases the cost of the antenna.

Moreover, the antenna module described in the document is of a linear shape, and is supplied in series, because of which it is actually very difficult to obtain an accurate in-phase supply of the horns and it is therefore absolutely necessary to effect a length adjustment of the individual supply lines to improve this result. It remains however difficult to obtain an accurate in-phase supply of all the horns when a wide operating frequency band is required. In addition, the solution suggested by the documents to solve this problem, results in a very complicated shape of the antenna, and also in an assembly and adjusting procedure which are too critical to have them effected during, for example, large-series production.

SUMMARY OF THE INVENTION

It is an object of the present invention to provide a novel high-frequency antenna module in which these disadvantages are obviated.

According to the present invention, these problems are solved by using an antenna unit module such as is defined in the opening paragraph, characterized in that there are four horns, that the apertures are of a square cross-section and in a plane parallel to a reference plane P, form a bidimensional square network obtained by uniformly increasing that the horn apertures through the thickness of a plate in which they are formed. The waveguide supply network is of the "planar" type because it is distributed in one single plane parallel to the reference plane P, and is of the type commonly referred to as "tree-structured" because the horns are fed in-phase with the aid of T-shaped power dividers whose bars are symmetrical. The wave-guide sections have dimensions a and b defined by the relationships $a>b$ and $a=\lambda_c/2$, where $\lambda_c$ is the cut-off wavelength of the waveguide. The small dimension b is placed in parallel with the reference plane P in the planar network so that the latter is capable of propagating the $TE_{01}$ mode in accordance with which the electric field vector $\vec{E}$ propagates parallel to the plane of this supply network. The branches of the power dividers are rectilinear or curved such that the shape of these waveguides branches enable the propagation of the electric vector $\vec{E}$ perpendicularly to their skirts, which are perpendicular relative to the plane of the network.

In one embodiment, this unit module is characterized in that each internal throat of the horn has a cross-section equal to those of the waveguides and are individually connected to a waveguide of the network via an elbow having a bend which is intersected by the reference plane P. Each individual supply waveguide is linear and is connected to one of the symmetrical linear branches of a first T-shaped power divider via an elbow whose bend is located in the plane of the network (intersected by the plane P). The main branch of this power divider is curved. Each group of two horns thus formed is connected to one of the curved symmetrical branches of a second T-shaped power divider whose main branch is also curved, so that the two two-horn groups thus formed are symmetrically fed relative to a plane Q'. This plane is defined as being perpendicular to both the reference plane P and a plane Q and such that the curvature of the branches of the two power dividers enable the propagation of the electric field vector $\vec{E}$ perpendicularly to the waveguide sidewalls which are perpendicular to the plane of the network.

The present invention has also for its object to provide a high-frequency antenna, characterized in that it comprises a number of such unit modules which is a multiple of four, which are each fed by a tree-structured planar network of the same type as the network distributed within each module and in the same plane as the latter, such that all the horns of the antenna are fed in-phase.

According to one embodiment, this antenna is characterized in that it is formed by two plates with electrically conductive surfaces, the horns being formed in the thickness direction of the first plate, the horn apertures terminating on the first face of this plate and the throats on the second face, the waveguide supply network being formed by slots made in the first face of the second plate, these slots constituting three of the four faces of the waveguides and applying the second face of the first plate on the first face of the second plate forming the fourth face of the waveguides and the connections to the horns.

According to a further embodiment, this antenna is characterized in that it is formed by two plates whose surfaces are electrically conducting, the horns being formed in the thickness direction of the first plate, the horn apertures terminating in the first face of this plate and the throats in the second face, the waveguide supply network being formed by recessed slots made in this second face and constituting three of the four faces of the waveguides, the second plate having a first flat face and applying the second face of the first plate on the first face of the second plate forming the fourth face of the waveguides and the connections of the horns.

The antenna realized in accordance with the present invention has several advantages. First of all, it has the lowest possible losses because of the fact that it is entirely fed by the waveguides with the exclusion of any other type of dielectric except the air.

In addition, given the tree-structure of the supply network, all the horns are fed in-phase, through a wide band of frequencies, without the necessity of making adjustments.

Furthermore, given the planar shape of the supply network, the antenna can be realized with the aid of two plates only, which may be metal plates or metal-plated plates, by a very simple manufacturing procedure.

In addition, the antenna thus realized has excellent mechanical qualities. It is particularly robust, weather, and ageing-resistant.

Finally, this antenna has high technical qualities. It can function in the high-frequency range, for example 12 GHz, and in a very wide frequency band. Its directivity and its gain performances can even be adapted to receiving television broadcasts via satellites when appropriate dimensions of the horns and the waveguides are chosen.

This antenna actually satisfies one of the essential conditions required for this latter application: it has not secondary network lobes.

BRIEF DESCRIPTION OF THE DRAWING

The invention and how it can be put into effect will be more apparent from the following description given by way of example with reference to the accompanying drawing figures, where.

DESCRIPTION OF THE PREFERRED EMBODIMENTS

Figure 1:
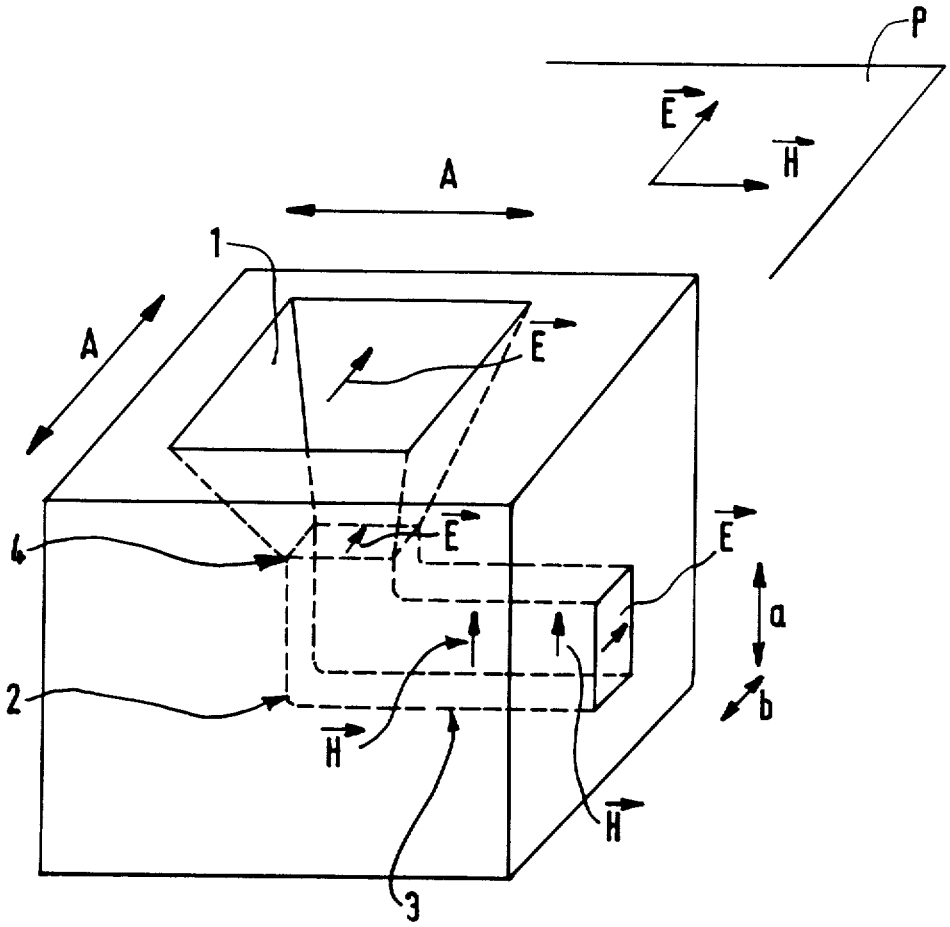
FIG. 1 is a perspective view of a radiating element of a unit module according to the invention.

As is shown in a perspective view in FIG. 1, the radiating element of a unit module of the antenna according to the invention, is constituted by a horn 1 whose aperture has a square section with side A. During operation of the antenna, to enable the reception or transmission of a linearly polarized wave, the aperture of the horn is placed in parallel with a reference plane P defined by the direction of propagation of the electric field $\vec{E}$ and the magnetic field $\vec{H}$ in the environment exterior to the antenna, and the sides of the square aperture of the horn are positioned either in parallel with electric field $\vec{E}$ or in parallel with the magnetic field $\vec{H}$ of the environment exterior to the antenna.

The throat 4 of the horn 1 is connected to the waveguide 3 via an elbow 2. The waveguide 3 and the internal throat 4 have a rectangular cross-section with sides a and b, such that $a>b$, if $a=\lambda_c/2$, wherein $\lambda_c$ is the cut-off wavelength of the waveguide, the waveguide propagates the $TE_{01}$ mode. The electric field $\vec{E}$ propagates in parallel with side b and the magnetic field $\vec{H}$ propagates in parallel with side a.

The waveguide 3 is positioned such that the dimension b of its section is in parallel with the reference plane P and the dimension a is perpendicular to the reference plane P. In these circumstances, the electric field $\vec{E}$ propagates in the waveguide 3 in parallel with the reference plane P, and the magnetic field $\vec{H}$ propagates perpendicularly to the reference plane P. The waveguide 3 is called an E-plane waveguide.

Figure 4:
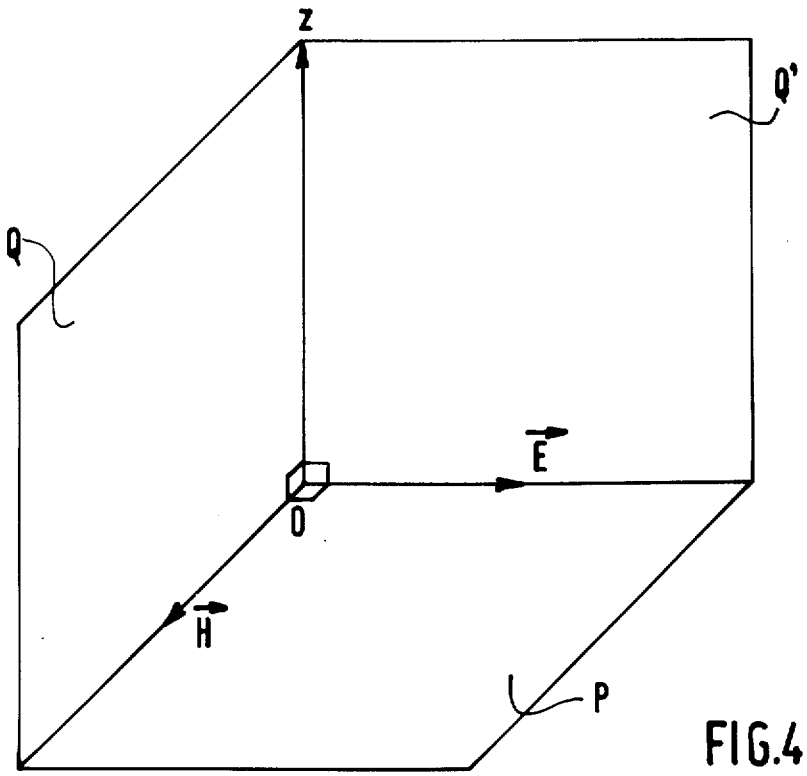
FIG. 4 illustrates the respective positions of the reference plane P and the symmetry planes Q and Q' of the supply network.
Figure 8:
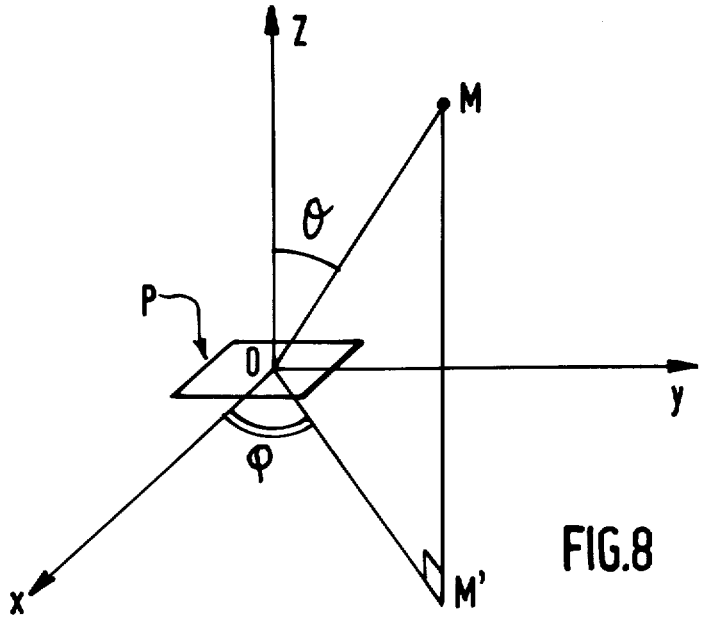
FIG. 8 shows the angular coordinates of a spatial point M relative to the reference plane P.

The angle of the elbow 2 connecting the throat 4 to the waveguide 3 is consequently positioned in a plane parallel to a plane Q, the plane Q being defined as being perpendicular to the plane P and in parallel with one of the sides of the horn apertures. When operating in accordance with the $TE_{01}$ mode in an elbow 2, this plane is in parallel with the vector $\vec{H}$. The elbow 2 may be called "elbow plane $\vec{H}$". In the environment exterior to the antenna, the plane Q is defined, during operation, by the magnetic field $\vec{H}$ and the perpendicular oz relative to the plane P, as is shown in FIG. 4.

Figure 2A:
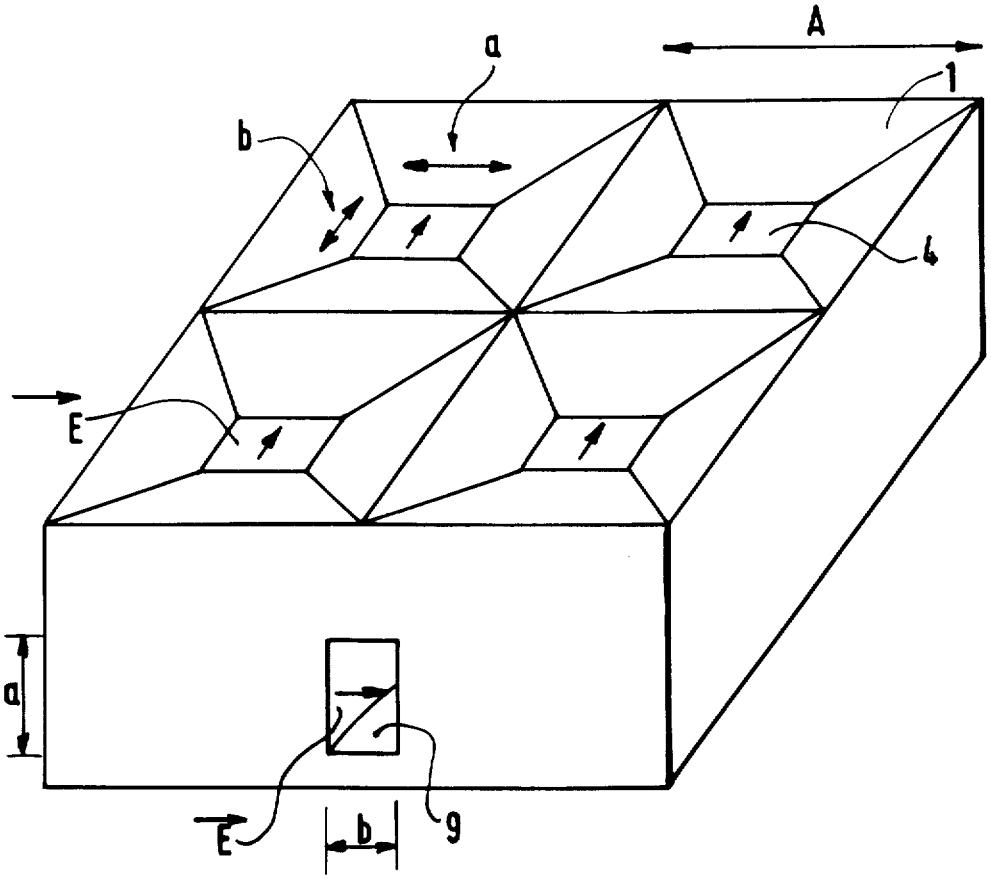
FIG. 2*a* is a perspective view of a unit module according to the invention.

The antenna module according to the invention is formed by four horns whose apertures form a repeating design by simple translation, in accordance with the two axes parallel to the sides, with the same step size, in a plane parallel to the reference plane P, as is shown in FIG. 2*a*, in a perspective plan view. Consequently, this module has a square shape in this plane.

Figure 2B:
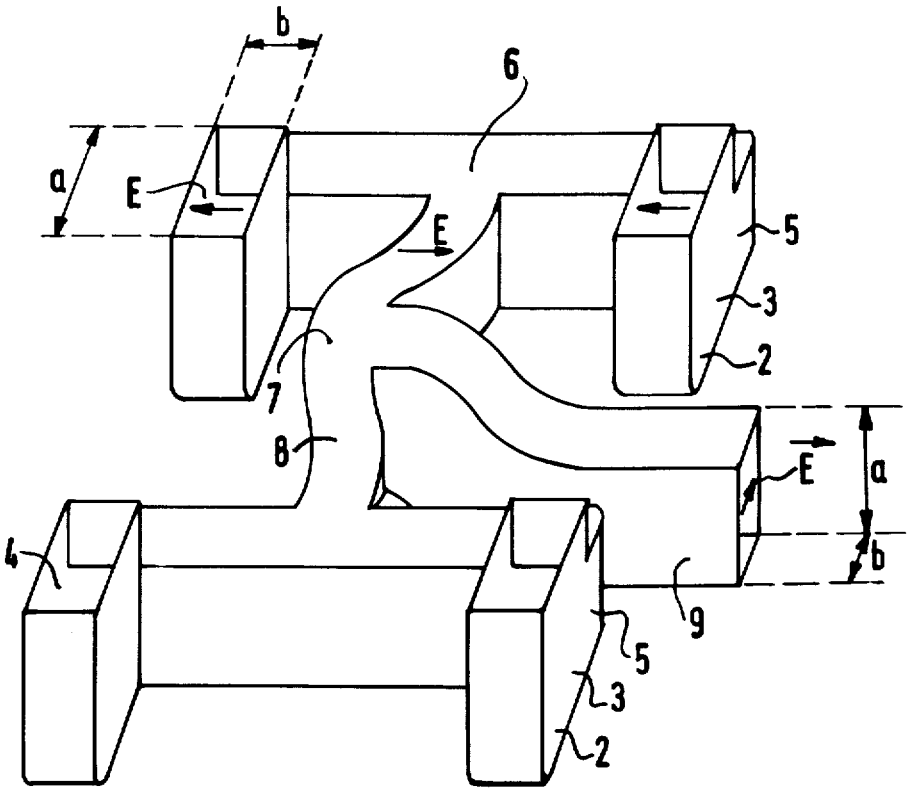
FIG. 2*b* is a perspective view of the supply network of this module.

The supply network of these four horns is shown in a perspective view in FIG. 2*b*. This network is a "planar" network because it is distributed in a single plane parallel to the reference plane P. All the waveguides interconnecting the individual supply guides 3 of the horns are of the same type as the guides 3, that is to say E-plane waveguides. The planar supply network is consequently an E-plane network.

Moreover, to enable the supply of the four in-phase horns, this network is of the type having a "tree-structure". Actually, the horns are fed pair-wise in a symmetrical manner relative to a plane parallel to plane Q, for forming two groups of identical radiating elements. Thereafter the two groups thus formed are symmetrically fed, relative to a plane which is in parallel with a plane Q', this plane Q' being defined as being perpendicular to both the reference plane P and the plane Q, as is shown in FIG. 4. In the environment externally of the operative antenna, the plane Q' is defined by the electric field E and the perpendicular oz relative to the plane P.

Figure 3:
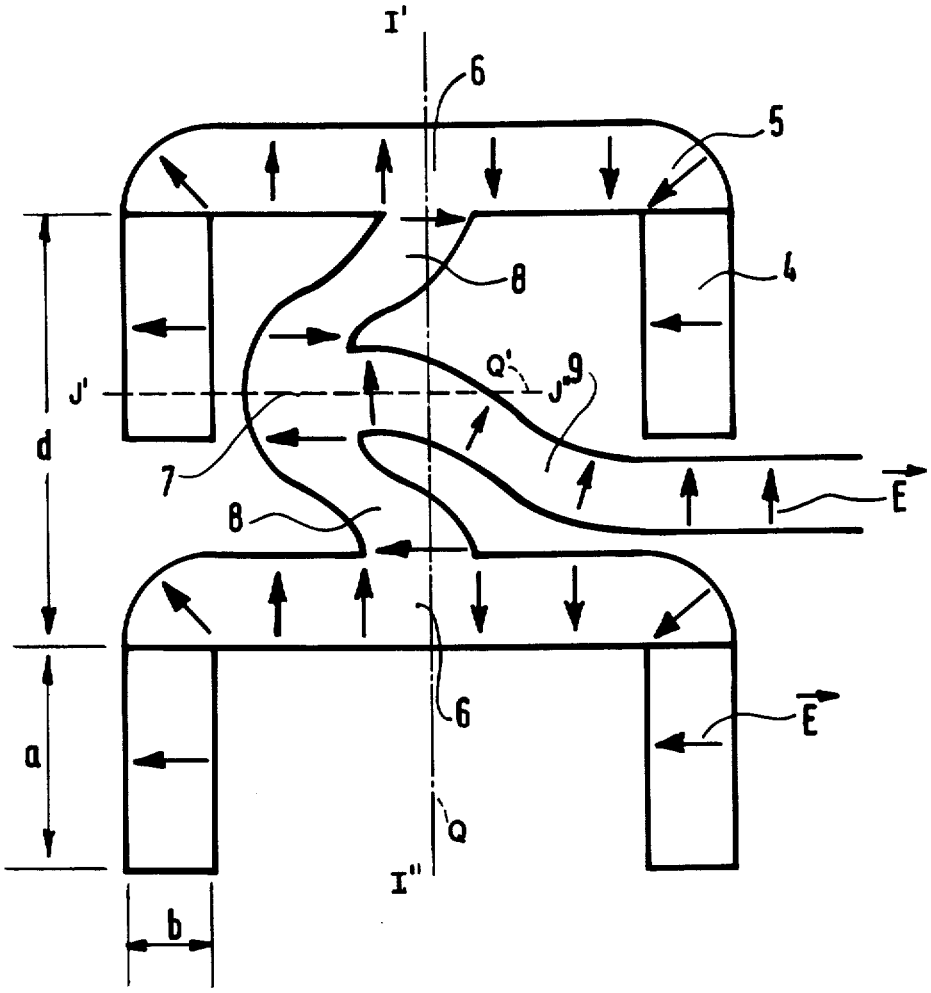
FIG. 3 illustrates, in a sectional view parallel to the reference plane P, the supply network of this module.

As is shown in a perspective view in FIG. 2b and in a cross-sectional view parallel to plane P in FIG. 3, the supply symmetry of the two horns can be obtained by means of a planar network such that the elbows 5, whose bends are intersected by the plane P, connect the individual supply guides 3 of these horns to a T-shaped power divider 6 intersected by the same plane. The symmetry plane of the system formed by the two horns, the two elbows 2, the two individual guides 3, the two elbows 5 and the upper bar of the power divider 6, is a plane parallel to Q, and has a location indicated by I'I" in FIG. 3.

The supply symmetry thus formed for the two groups of two horns is obtained by connecting the waveguides 8 coming from the power divider 6 via a T-shaped power dividers 7 intersected by the plane P. For the upper bar of this power divider 7, which has an output 9 and the guide sections 8, a plane parallel to Q', having a location indicated by J'J" in FIG. 3, may be considered as the symmetry plane.

Thus, for each horn, the length of the feed path is exactly the same and the horns are fed perfectly in-phase.

The waveguide sections 8, the upper bar of the T forming the power divider 7, and the output waveguide section 9 of this divider are curved, as is shown in FIGS. 2b and 3, so that the electric field vector $\vec{E}$ remains perpendicular to the vertical sidewalls of the waveguide during the propagation in the $TE_{01}$ mode.

A high-frequency antenna can be assembled from a multiple of four of such unit modules fed by a tree-structured planar network of the same type as the network distributed within each module and in the same plane as the latter. Thus, the antenna may comprise a sufficient number of radiating elements to obtain the desired gain for the antenna and all the radiating elements of the antenna are nevertheless fed in-phase.

Because of the fact that the waveguide supply network is designed in a plane parallel to the plane of the horn apertures, it is possible to realize the antenna completely in the form of a planar antenna using only two plates. These plates may be metal, machined plates, or they may be made of moulded plastic with metal-plated surfaces.

Figure 5A:
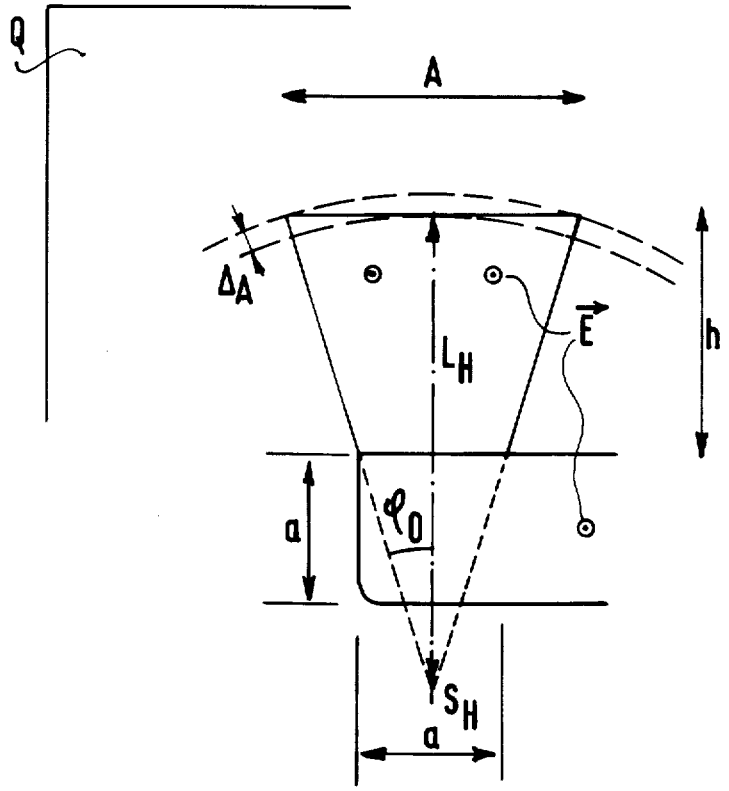
FIGS. 5*a* and 5*b* show a radiating element of the unit module, in a sectional view parallel to the plane Q' and a sectional view parallel to the plane Q, respectively.
Figure 5B:
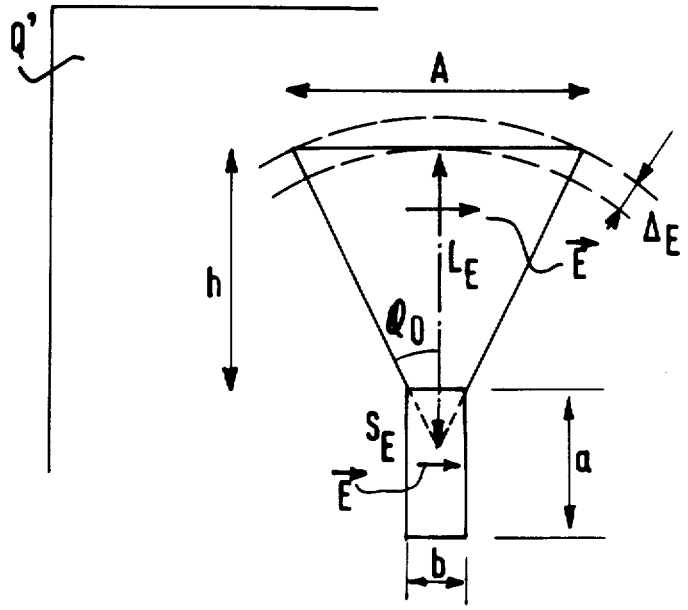
Figures 6A, 6B:
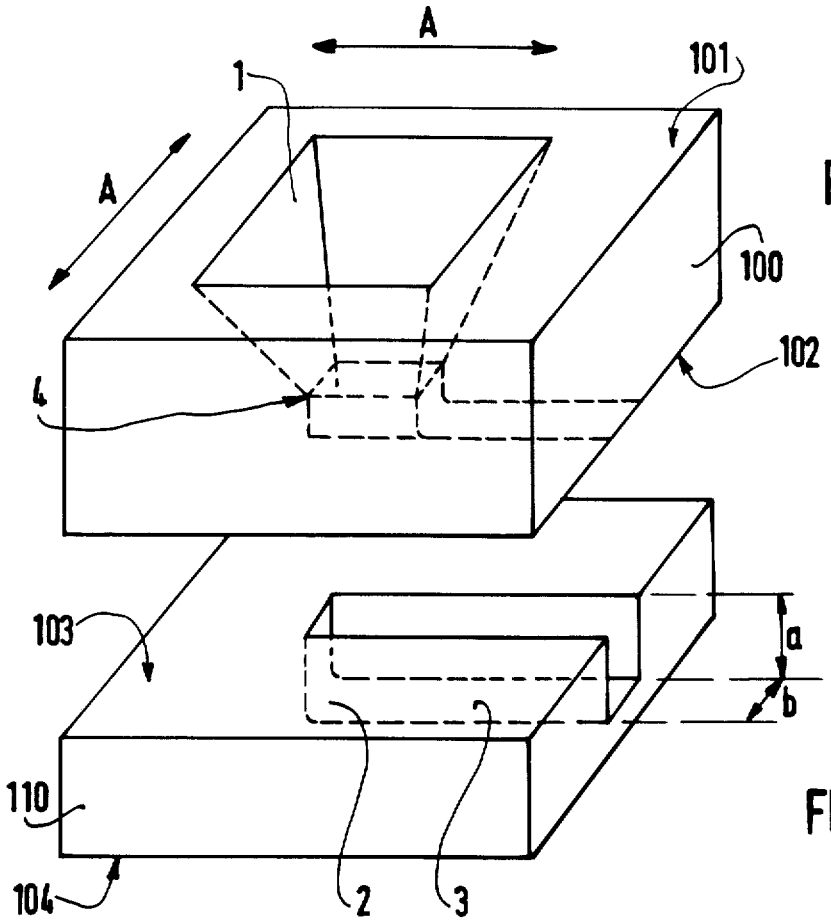
FIGS. 6*a* and 6*b* show portions of the two plates constituting an antenna according to the invention, in one practical embodiment.

In accordance with a first embodiment illustrated by FIGS. 6a and 6b, the antenna is formed by two plates 100 and 110, whose main faces 101 and 102 as regards plate 100, and the main faces 103 and 104 for plate 110 are arranged in parallel with the reference plane. The plate 100 comprises a number of unit modules which is a multiple of four, of four horns positioned adjacently, in such manner that all the horns uniformly increase in cross-sectional area through the thickness of the plate 100 by uniformly increasing the dimensions of the sides of the square apertures. The horns are made such in the thickness direction of the plate 100 that the apertures are flush with the face 101 and that the throats 4 are flush with the face 102, the thickness of the plate 100 being positioned at the same height as the height h of the horns (see FIGS. 5a and 5b). The plate 110 comprises the elbows 2 and the planar supply network for the antenna formed by slots recessed in the face 103 of this plate. The slots have a width b and a depth a and constitute three of the faces of the waveguides of the network. Applying the face 103 of the plate 110 on the face 102 of the plate 100 forms the fourth face of the waveguides of rectangular cross-section of the supply network and connect the horns to the network thus formed. It should be noted that the plate 110 must have a thickness which is somewhat larger than the quantity a, so that the overall thickness of the planar antenna thus formed is given a value which is slightly higher than the quantity a+h.

Figure 7:
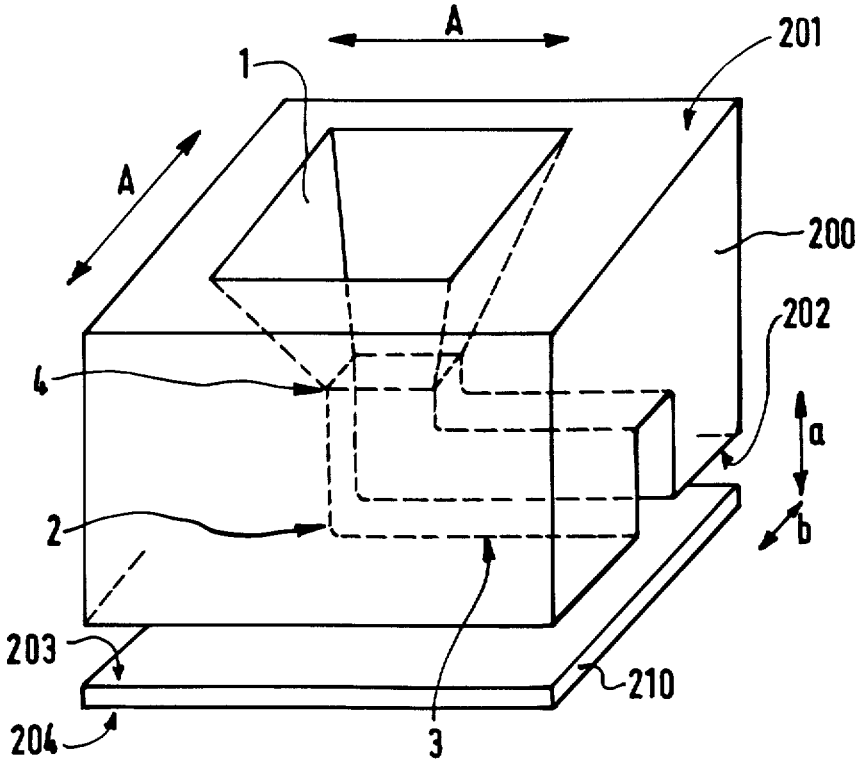
FIG. 7 shows a radiating element of the antenna in another practical embodiment.

In accordance with a second embodiment, illustrated by FIG. 7, the antenna is formed from two plates 200 and 210 whose main faces 201 and 202 as regards plate 200, and the main faces 203 and 204 as regards the plate 210 are in parallel with the reference plane P. The plate 200 comprises the unit modules which are positioned adjacently to each other, as in the above-described embodiment. The horns are formed in the thickness direction of the plate 200 such that the apertures are flush with the face 201 and that the throats are located in the depth of the material forming the plate 200. The latter is given a uniform thickness in the height direction h of the horns increased by the value of the dimension a of the waveguides. The antenna supply network is produced on the face 202 of the plate 200 in the form of recessed slots having a width b and a depth a, and elbows 2 by means of which it is possible to connect the throats of the horns to the slots. The plate 210 is a single strip with parallel faces. Applying the face 203 of the plate 210 on the face 202 of the plate 200 forms the fourth face of the waveguides of the supply network.

The antenna produced in accordance with one of the above-described embodiments is consequently simple and cheap to produce. It can be made in large series. It is of a high mechanical strength and does not require adjustment during mounting. To still further facilitate placing the plates 100 and 110 or 200 and 210 one upon the other, positioning pins or any other system for positioning and fixing known to a person skilled in the art may be provided on these plates. The plates may, for example, be kept together face-to-face by means of screws.

Since this antenna does not contain any dielectric material, the losses therein are as low as possible, and on the other hand the antenna is extremely resistant to ageing.

Moreover, this antenna is of a small size and has a low weight. It is consequently particularly easy to install and not very difficult to support it.

Consequently, such an antenna is extremely suitable for use by the general public for receiving television broadcasts via satellites. In such a receiving system, the antenna is actually an element which derives its importance from two features: in the first place, the receiving quality directly depends on the characteristics of the antenna, and secondly the cost of the antenna and its support and also the cost of mounting it and directing it to the satellite determine for a large part the final cost of the receiving system.

The following example is given to demonstrate that the antenna according to the invention may further have technical characteristics suitable for receiving television broadcasts which are relayed via artificial satellites.

EMBODIMENT

As is known, an antenna intended to receive television broadcasts via satellites must be able to receive a circular polarization which is either a right-hand circular polarization or a left-hand circular polarization depending on the transmitting satellite.

It is equally known that the polarization of an electromagnetic wave is defined by the direction of the electric field $\vec{E}$ in space. If in a point in space the electric field factor $\vec{E}$ remains parallel to a straight line, which is of necessity perpendicular to the direction of propagation of the wave, this wave is polarized rectilinearly.

In contrast thereto, the wave is circularly polarized when the end of the electric field vector $\vec{E}$ describes a circle in the plane perpendicular to the direction of propagation. The polarization is a right-hand circular polarization when $\vec{E}$ rotates clockwise for an observer looking in the direction of propagation. The polarization is a lefthand circular polarization in the other case.

A circularly polarized wave may be divided into two linearly polarized waves, which are perpendicularly to each other and whose phases are shifted through $\pm\pi/2$.

The antenna intended for the above-described use may consequently be realized in accordance with the following principle: the two perpendicular components, resulting from the transmission by the satellite of a circularly polarized wave, are pulled-in, thereafter assembled with the appropriate phase shift ($+\pi/2$ or $-\pi/2$ depending on whether a right-hand or a left-hand circular polarization is involved).

Making this principle operative assumes the use of a depolarizing radome before the antenna. This radome is designed such that it delays one of the components of the circularly polarized wave, thus producing the necessary phase-shift. The two linearly polarized waves are thus in-phase and their vectorial composition results in a linearly polarized wave capable of being received by an antenna with a single linear polarization, such as the antenna according to the present invention. The depolarizing radome is not described here as, strictly speaking, it does not form part of the invention.

Figure 9:
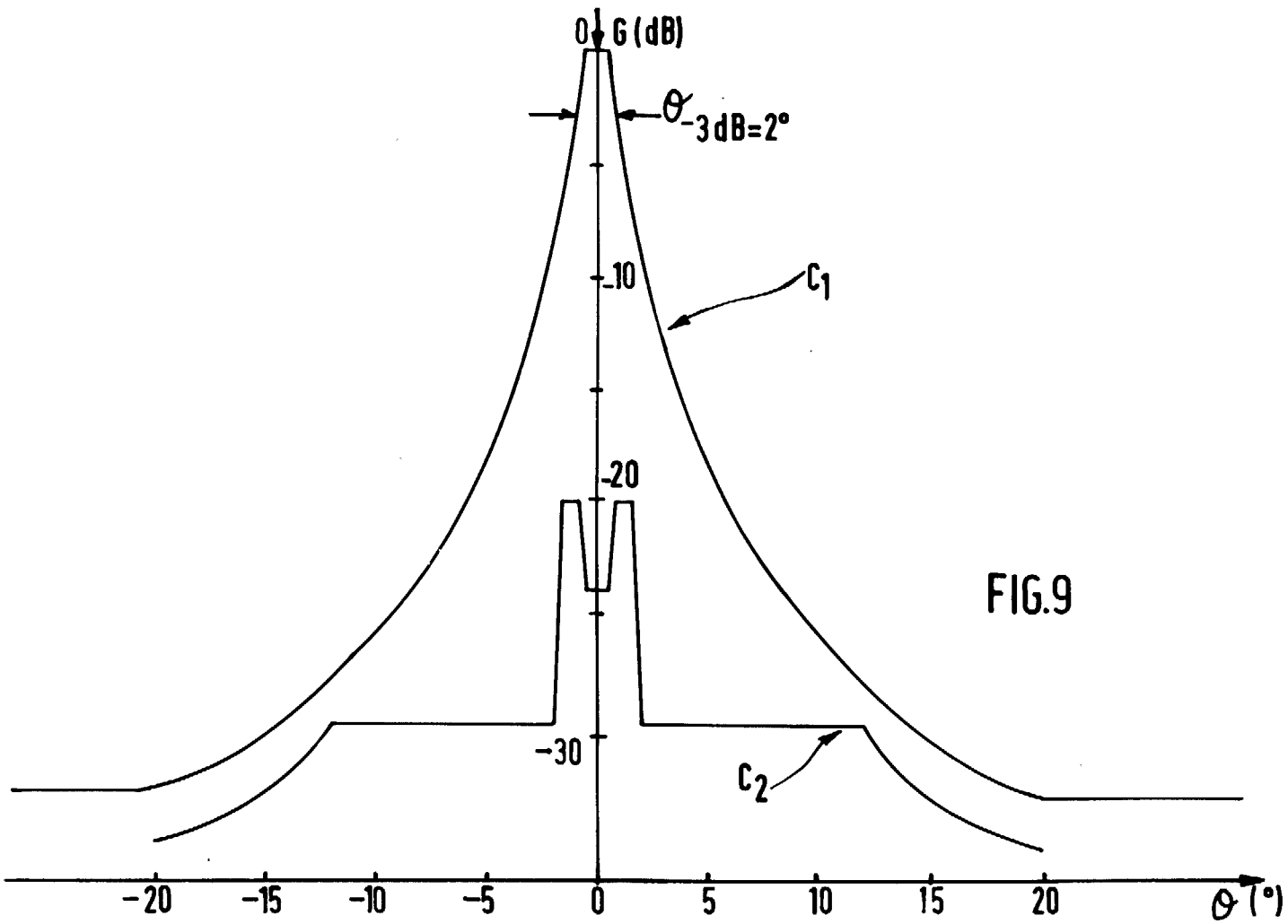
FIG. 9 shows the envelope $C_1$ of the radiation diagram of the antenna imposed by the CCIR standards when the antenna is used for the reception of television transmissions via satellite and the envelope $C_2$ of the cross-polarization diagram.

One will moreover recall that for the intended application the antenna must satisfy standards formulated by the CCIR (Comité International de Radiocommunication). These conditions are as follows:

the frequency band must be located between 11.7 and 12.5 GHz;

the radiation diagram of the antenna must be below the envelope represented by the curve $C_1$ shown in FIG. 9, in accordance with which an attenuation of 3 dB of the main lobe corresponds to a beam aperture $\theta$ of 2°, expressed by the relation:

$\theta_{-3\,dB}=2°$ which is the aperture of the beam at half power; and in accordance with which the secondary lobes are attenuated by 30 dB to 12°;

the cross-polarization must be below by the envelope represented by the curve $C_2$ in FIG. 9;

the ratio between the antenna gain G and the noise temperature T in degrees Kelvin must be:

$$G/T \geqq 6\ \text{dB}\ {}^{\circ}\text{K}^{-1}.$$

As shown in FIG. 2b, the supply network of the unit module of the antenna renders the propagation of the $TE_{01}$ mode possible. So as to ensure that this mode can propagate it is necessary that the large dimension a of the waveguides perpendicular to the electric field vector $\vec{E}$ is defined by the relation (1):

$$a=\lambda_c/2 \tag{1}$$

wherein $\lambda_c$ is the cut-off wavelength of the guide. Actually, when the dimension a is very small, then the length of the guided wave varies too much as a function of the frequency, and, inversely, if the dimension a is too great, then the guide propagates a plurality of modes simultaneously.

For the frequency band 11.7–12.5 GHz, it is possible to adopt a cut-off frequency $f_c=10$ GHz which corresponds to a cut-off wavelength $\lambda_c=30$ mm and consequently a=15 mm is a good compromise.

An additional, specific problem which occurs is the problem caused by the lobes of the network. Actually, the overall gain of the antenna 6 is linked to the gain of a radiating element $G_1$ by means of the relation (2)

$$G=G_e\times F_r\times F \tag{2}$$

in which $F_r$=the network factor

F=correction factor for an element.

The network factor $F_r$ is a function of the radiation angle $\theta$, the latter being defined, as is shown in FIG. 10, by the angle between the normal oz relative to the plane xoy comprising the plane P of the antenna, and the radiation direction Om. The network factor $F_r$ verifies the relation (3)

$$F_r=\frac{\sin(nU)}{n\ \text{Sin}\ U} \tag{3}$$

in which n is the number of radiating elements forming the antenna and $$U=\pi(d/\lambda)\ \text{Sin}\ \theta \tag{4}$$

wherein d is the spacing between the radiating elements and $\lambda$ is the length of the propagated wave.

The relation (2) shows that a maximum radiation is obtained when the network factor is:

$F_r=1$

So as to ensure that the lobes of the network are completely avoided, it is necessary for the function $F_r$ to have only one sole maximum corresponding to the main lobe, that is to say that the term Sin U does assume a value 0 once only. This condition is satisfied when:

$\lambda/d>1$ that is to say when:

$$d<\lambda \tag{5}$$

This relation establishes that in order to ensure that the network lobes are completely avoided, it is necessary for the spacing d between the radiating elements to be less than the wavelength $\lambda$ propagated in the waveguide. In the opposite case, network lobes appear. d is chosen, for example, equal to 22 mm.

The dimension b is given by (see FIG. 3):

$$b=(d-a-2\delta)/2 \quad (6)$$

wherein $\delta$ is the minimum thickness of the materials separating two waveguides. When $\delta=0.5$ mm, then it is obtained that:

b=3 mm.

In accordance with the present invention this condition can easily be satisfied by the dimensions and characteristics of the radiation elements and the waveguides given in Table I.

TABLE I

| | | |
|---|---|---|
| f = 12.5 GHz | $f_c$ = 10 GHz | $G_e$ = 9.5 dB |
| $\lambda$ = 24 mm | $\lambda_c$ = 30 mm | $TE_{01}$ |
| Plan H $\phi_O$ = 12.68 | $L_H/\lambda$ = 2.22 | $L_H$ = 53.33 mm |
| Plan $\epsilon$ $\Theta_O$ = 22.61 | $L_\epsilon/\lambda$ = 1 | $L_E$ = 24 mm |
| a = 15 mm b = 3 mm | d = A = 22 mm | h = 20 mm |

This Table is completed by FIGS. 5a and 5b, which show a sectional view of a radiation element in parallel with plane Q and consequently with "plane H", and in parallel with plane Q', so with "plane E".

The gain $G_e$ of such a radiating element can be calculated using the relations given in the publication by Nha-BUI-NA published by MASSON, entitled "Antennes microondes".

For the dimensions opted for, this gain reaches a value of the order of $G_e \approx 9.5$ dB.

An antenna realized with the aid of n=512 radiating elements or with the aid of N=128 unit modules in accordance with the invention then provides, assuming the losses in the lines to be equal to 0.5 dB, an overall gain G=36.1 dB.

The coupling between the elements may be disregarded. Adaptations can be provided in the region of the elbows or the power dividers for improving these results.

However, this antenna as such perfectly satisfies the CCIR standards. Particularly the radiation diagram obtained perfectly satisfies the conditions of FIG. 9, both for the envelope $C_1$ and for the envelope $C_2$ of the cross-polarization diagram.

Actually, from the value imposed for the antenna gain-to-noise temperature ratio, the antenna must have a gain of at least 34 dB.

The value obtained here of over 36 dB is completely adequate and the fact that the antenna does not have secondary network lobes is one of its most interesting characteristics for this application.

Finally, the possibility to realize such a dual-plate antenna as has been described in the foregoing provides a perfect arrangement for this large scale public use.

It will, however, be obvious that there are further possible uses for this antenna, when the elements are appropriately calculated, without departing from within the scope of the present invention such as it is defined in the accompanying Claims.

What is claimed is:

1. A unit module for an antenna for rectilinearly-polarized waves, said unit module comprising:

(a) four horn-type radiating elements having square apertures parallel to a reference plane P and arranged in a rectangular array, said horn-type radiating elements being formed in a common plate of material of predetermined thickness and having uniformly-increasing cross-sectional areas through at least a part of said thickness from respective throats thereof to said square apertures thereof;

(b) a waveguide supply network for propagating $TE_{01}$-mode waves, said network being disposed in the modules beneath the horn-type radiating elements and including a power divider network and means for connecting said power divider network to the throats of the horn-type radiating elements;

said power divider network including a plurality of rectangular waveguide sections arranged with respect to planes Q and Q' which are perpendicular to the reference plane P and to each other, the plane Q bisecting the module into two equal parts and the plane Q' bisecting the module into larger and smaller parts, each of said waveguide sections having a pair of opposing sidewalls of width (b) extending parallel to the reference plane P and having a pair of opposing side walls of width (a) extending perpendicularly to said reference plane P, where (a)>(b), where (a)=$\lambda_c/2$, and where $\lambda_c$ is the waveguide cut-off wavelength, said waveguide sections including:

1. a first section forming a central bar of a first T-shaped power divider, said first section curvilinearly extending from the periphery of the unit module where both sidewalls of width (a) lie on the side of the plane Q' defining the larger part of the module, and extending past the plane Q to a region of the module where both side walls of width (a) lie on opposite sides of the plane Q';
2. a second section forming a top bar of the first T-shaped power divider and forming at opposite ends thereof central bars of respective second and third T-shaped power dividers, said second section curvilinearly extending from a central portion thereof, which is connected to the first section, to said opposite ends where the respective sidewalls of width (a) lie on opposite sides of the plane Q;
3. a third section forming a top bar of the second T-shaped power divider and extending from a central portion thereof, which is connected to the second section, to opposite ends thereof in the vicinity of the throats of first and second ones of the horn-type radiating elements; and
4. a fourth section forming a top bar of the third T-shaped power divider and extending from a central portion thereof, which is connected to the second section, to opposite ends thereof in the vicinity of the throats of third and fourth ones of the horn-type radiating elements;

said means for connecting the power divider network to the throats of the horn-type radiating elements comprising a first group of four elbow-shaped rectangular waveguide sections for connecting the ends of the third and fourth waveguide sections to respective throats of the horn-type radiating elements.

2. A unit module as in claim 1 where:

(a) each of said third and fourth waveguide sections extends linearly from the central portion thereof to the opposite ends thereof; and (b) the waveguide supply network includes a second group of four elbow-shaped waveguide sections for connecting the opposite ends of the third and fourth waveguide sections to respective ones of the first group of four elbow-shaped waveguide sections, each of said first group having a bend formed by opposing sidewalls of width (b) which are bisected by a plane parallel to plane Q, and each of said second group having a bend formed by opposing side walls of width (a) which are bisected by a plane parallel to plane P.

3. A unit module as in claim 1 or 2 where the horn-type radiating elements and three of the sidewalls of each waveguide section are formed in a first plate of material, and where the fourth sidewall of each waveguide section is formed by a second plate attached to one side of the first plate.

4. A unit module as in claim 3 where each of the plates comprises electrically conductive material.

5. A unit module as in claim 3 where each of the plates comprises a dielectric material coated with an electrically conductive material.

6. A unit module as in claim 1 or 2 where at least the horn-type radiating elements are formed in a first plate of material, and where at least a part of the waveguide supply network is formed in a second plate of material, said first and second plates of material being mated to each other to form said unit module.

7. A unit module as in claim 6 where each of the plates comprises electrically conductive material.

8. A unit module as in claim 6 where each of the plates comprises a dielectric material coated with an electrically conductive material.

9. An antenna for rectilinearly-polarized waves, said antenna including a plurality of unit modules each comprising:

(a) four horn-type radiating elements having square apertures parallel to a reference plane P and arranged in a rectangular array, said horn-type radiating elements being formed in a common plate of material of predetermined thickness and having uniformly-increasing cross-sectional areas through at least a part of said thickness from respective throats thereof to said square apertures thereof;

(b) a waveguide supply network for propagating $TE_{01}$-mode waves, said network being disposed in the modules beneath the horn-type radiating elements and including a power divider network and means for connecting said power divider network to the throats of the horn-type radiating elements;

said power divider network including a plurality of rectangular waveguide sections arranged with respect to planes Q and Q' which are perpendicular to the reference plane P and to each other, the plane Q bisecting the module into two equal parts and the plane Q' bisecting the module into larger and smaller parts, each of said waveguide sections having a pair of opposing sidewalls of width (b) extending parallel to the reference plane P and having a pair of opposing side walls of width (a) extending perpendicularly to said reference plane P, where (a)>(b), where (a)$=\lambda_c/2$, and where $\lambda_c$ is the waveguide cut-off wavelength, said waveguide sections including:

1. a first section forming a central bar of a first T-shaped power divider, said first section curvilinearly extending from the periphery of the unit module where both sidewalls of width (a) lie on the side of the plane Q' defining the larger part of the module, and extending past the plane Q to a region of the module where both side walls of width (a) lie on opposite sides of the plane Q';
2. a second section forming a top bar of the first T-shaped power divider and forming at opposite ends thereof central bars of respective second and third T-shaped power dividers, said second section curvilinearly extending from a central portion thereof, which is connected to the first section, to said opposite ends where the respective sidewalls of width (a) lie on opposite sides of the plane Q;
3. a third section forming a top bar of the second T-shaped power divider and extending from a central portion thereof, which is connected to the second section, to opposite ends thereof in the vicinity of the throats of first and second ones of the horn-type radiating elements; and
4. a fourth section forming a top bar of the third T-shaped power divider and extending from a central portion thereof, which is connected to the second section, to opposite ends thereof in the vicinity of the throats of third and fourth ones of the horn-type radiating elements;

said means for connecting the power divider network to the throats of the horn-type radiating elements comprising a first group of four elbow-shaped rectangular waveguide sections for connecting the ends of the third and fourth waveguide sections to respective throats of the horn-type radiating elements.

* * * * *